US006985166B2

(12) United States Patent
Chiang

(10) Patent No.: US 6,985,166 B2
(45) Date of Patent: Jan. 10, 2006

(54) COLOR PRINTER WITH AN OPTICAL ENCODING DISK FOR ECONOMIZING THE LENGTH OF A RIBBON

(75) Inventor: Chi-Chan Chiang, Taipei (TW)

(73) Assignee: Hi-Touch Imaging Technologies Co., Ltd., Pan-Chiao (TW)

( * ) Notice: Subject to any disclaimer, the term of this patent is extended or adjusted under 35 U.S.C. 154(b) by 127 days.

(21) Appl. No.: 10/708,704

(22) Filed: Mar. 19, 2004

(65) Prior Publication Data

US 2005/0157156 A1 Jul. 21, 2005

(30) Foreign Application Priority Data

Jan. 15, 2004 (TW) ..... 93101004 A

(51) Int. Cl.
*B41J 35/18* (2006.01)

(52) U.S. Cl. ..... 347/178

(58) Field of Classification Search ..... None
See application file for complete search history.

(56) References Cited

U.S. PATENT DOCUMENTS 4,586,834 A * 5/1986 Hachisuga et al. .... 400/120.13

FOREIGN PATENT DOCUMENTS

JP 61-177275 * 8/1986

* cited by examiner

*Primary Examiner*—Huan Tran
(74) *Attorney, Agent, or Firm*—Winston Hsu

(57) ABSTRACT

A color printer for economizing ribbon includes a ribbon including dye regions, and each dye region includes a plurality of dye areas for carrying dye of different colors. The color printer further includes a print head for transferring dye on the ribbon onto a subject, a ribbon-moving device for moving the ribbon so that the print head can transfer the dye on each of the dye areas of one dye region onto the subject to form a color picture, an optical sensing module installed on the side of the ribbon including an optical encoding disk driven by the ribbon-moving device generating a count when the ribbon-moving device moves the ribbon, and a control module for controlling the ribbon-moving device to move the next dye region of the ribbon to the print head after finishing printing one dye region of the ribbon according to the count of the optical encoding disk.

8 Claims, 7 Drawing Sheets

COLOR PRINTER WITH AN OPTICAL ENCODING DISK FOR ECONOMIZING THE LENGTH OF A RIBBON

BACKGROUND OF INVENTION

1. Field of the Invention

The present invention relates to a color printer and more particularly, to a color printer for driving a ribbon according to the count of an optical encoding disk so as to economize the length of the ribbon.

2. Description of the Prior Art

Please refer to FIG. 1, FIG. 1 is a perspective view of a ribbon apparatus of a conventional color printer 10. As shown in FIG. 1, the ribbon apparatus of the color printer 10 includes a ribbon 12, two light sources 14, 16, and two sensors 18, 20. The ribbon 12 includes a plurality of sequentially arranged dye regions 22. Each dye region 22 includes four dye areas 24, 26, 28, 30 for placing yellow dye, magenta dye, cyan dye, and overcoating dye. An opaque dividing section 32 is located between an overcoating dye area 30 and a yellow dye area 24. An opaque dividing section 34 and a transparent dividing section 36 are installed between the yellow dye area 24 and a magenta dye area 26. An opaque dividing section 34 and a transparent dividing section 36 are installed between the magenta dye area 26 and a cyan dye area 28. An opaque dividing section 34 and a transparent dividing section 36 are installed between the cyan dye area 28 and the overcoating dye area 30.

The light sources 14, 16 are located on one side of the ribbon 12 for producing light beams 38, 40 of two predetermined colors. The sensors 18, 20, corresponding to the light sources 14, 16, are located on the opposite side of the ribbon 12. The sensors 18, 20 are used to detect light beams 38, 40 penetrating through the ribbon 12 and produce corresponding signals to determine the position of the ribbon 12. The detection of an opaque dividing section 32 signals the beginning position of a new dye region 22 of the ribbon 12, and also corresponds to the beginning position of a yellow dye area 24. The detection of an opaque dividing section 34 and a transparent dividing section 36 by the sensors 18, 20 corresponds to the beginning position of the magenta dye area 26, cyan dye area 28, or overcoating dye area 30. The reservation of opaque dividing sections 34 and transparent dividing sections 36 for detection of the position of the ribbon 12 is a disadvantage of the prior art color printer 10 because it decreases the effective utilization of the ribbon 12, resulting in higher production costs of the ribbon 12.

SUMMARY OF INVENTION

It is therefore a primary objective of the claimed invention to provide a color printer for economizing an ribbon for solving the above-mentioned problem.

According to the claimed invention, a color printer for economizing an ribbon is proposed. The color printer includes a ribbon including a plurality of dye regions, and each dye region includes a plurality of dye areas for carrying dye of different colors. The color printer further includes a print head for transferring dye on the ribbon onto a subject, a ribbon-moving device for moving the ribbon so that the print head can transfer the dye on each of the dye areas of one dye region onto the subject to form a color picture, an optical sensing module installed on the side of the ribbon including an optical encoding disk driven by the ribbon-moving device for generating a count when the ribbon-moving device moves the ribbon, and a control module for controlling the ribbon-moving device to move the next dye region of the ribbon to the print head after finishing printing one dye region of the ribbon according to the count of the optical encoding disk.

These and other objectives of the claimed invention will no doubt become obvious to those of ordinary skill in the art after reading the following detailed description of the preferred embodiment, which is illustrated in the various figures and drawings.

DETAILED DESCRIPTION

Figure 1:
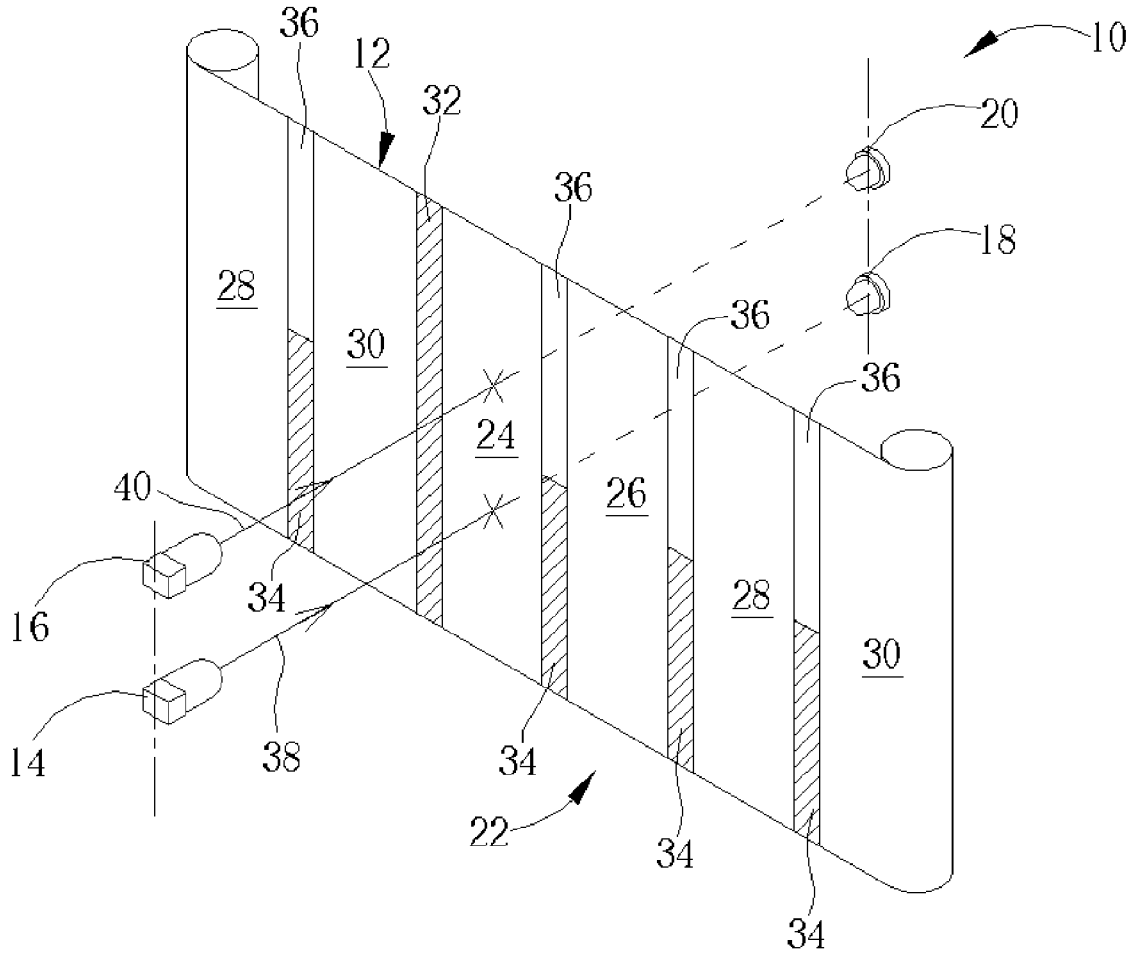
Fig. 1 Prior art
FIG. 1 is a perspective view of a ribbon apparatus of a conventional color printer.
Figure 2:
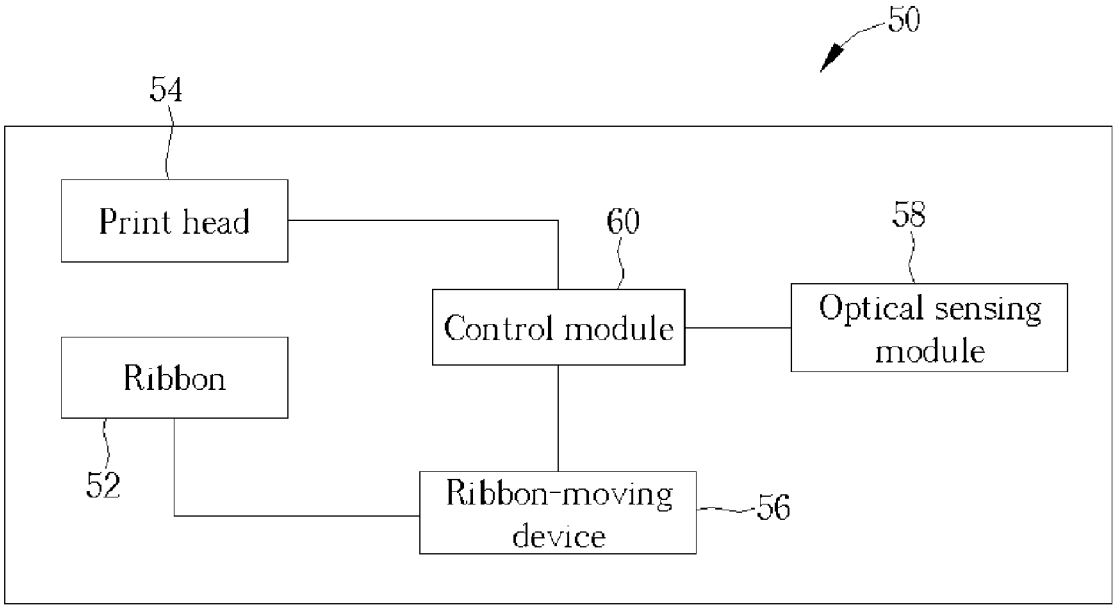
FIG. 2 is a functional block diagram of a color printer according to the present invention.

Please refer FIG. 2. FIG. 2 is a functional block diagram of a color printer 50 according to the present invention. The color printer 50 can be a photo printer using a thermal print transfer method. The color printer 50 includes a ribbon 52, a print head 54 for transferring dye on the ribbon 52 onto a subject, a ribbon-moving device 56 for moving the ribbon 12 so that the print head 54 can transfer the dye of the ribbon 52 onto the subject to form a color picture, an optical sensing module 58, and a control module 60 for controlling the ribbon-moving device 56 to move the ribbon 52 according to the detection of the optical sensing module 58.

Figure 3:
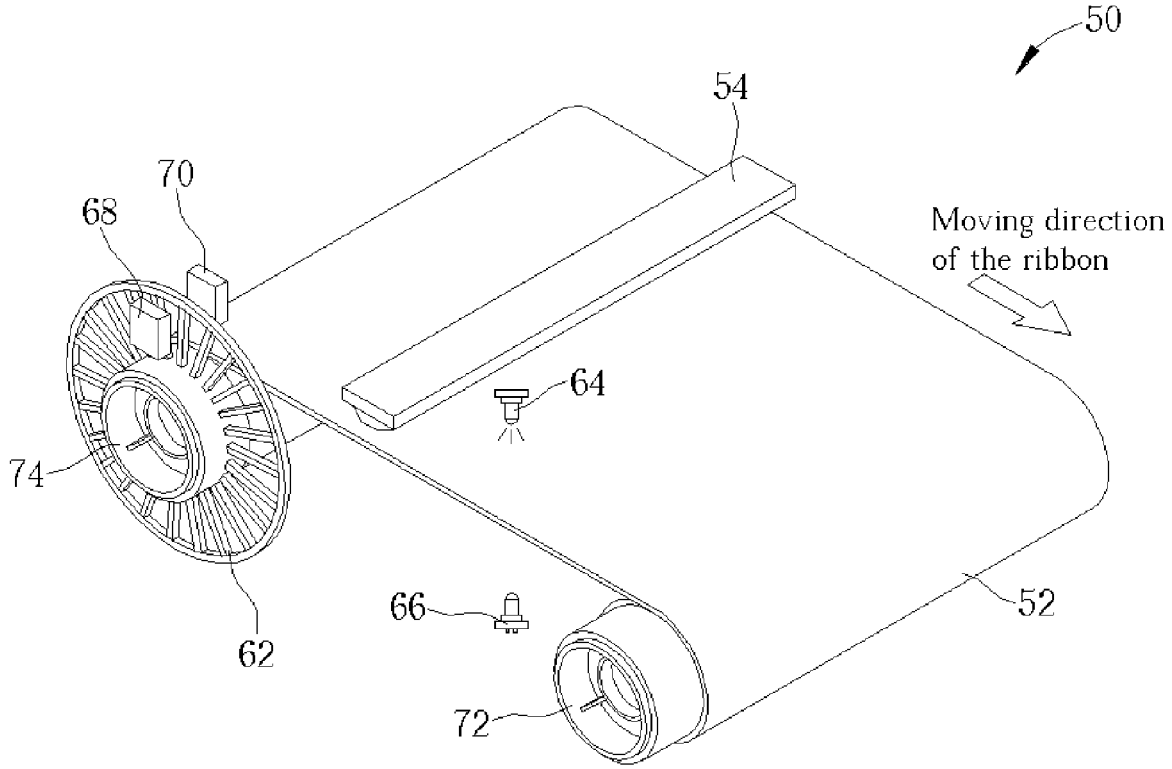
FIG. 3 is a perspective view of the color printer according to the present invention.

Please refer to FIG. 3. FIG. 3 is a perspective view of the color printer 50 according to the present invention. The optical sensing module 58 includes an optical encoding disk 62 driven by the ribbon-moving device 56 for rotating and generating a count when the ribbon-moving device 56 moves the ribbon 52, a first light source 64 for emitting light to the ribbon 52, a light sensor 66 for sensing the light which is emitted from the first light source 64 and penetrates the ribbon 52, a second light source 68 for emitting light to the optical encoding disk 62, and a light detector 70 for receiving the light emitted from the second light source 68 and passing through the optical encoding disk 62 so as to obtain the count of the optical encoding disk 62. The first light source 64 and the second light source 68 can be light emitting diodes (LEDs). The ribbon-moving device 56 includes a driving roller 72 and a feeding roller 74. The driving roller 72 moves the ribbon 52 in a predetermined direction, the ribbon 52 wound around the feeding roller 74 decreasing and the ribbon 52 wound around the driving roller 72 increasing. The driving roller 72 holds the printed part of the ribbon 52, and the feeding roller 74 holds the unprinted part of the ribbon 52. The ribbon-moving device 56 winds the ribbon 52 at a constant linear speed or at a constant angular speed.

Figure 4:
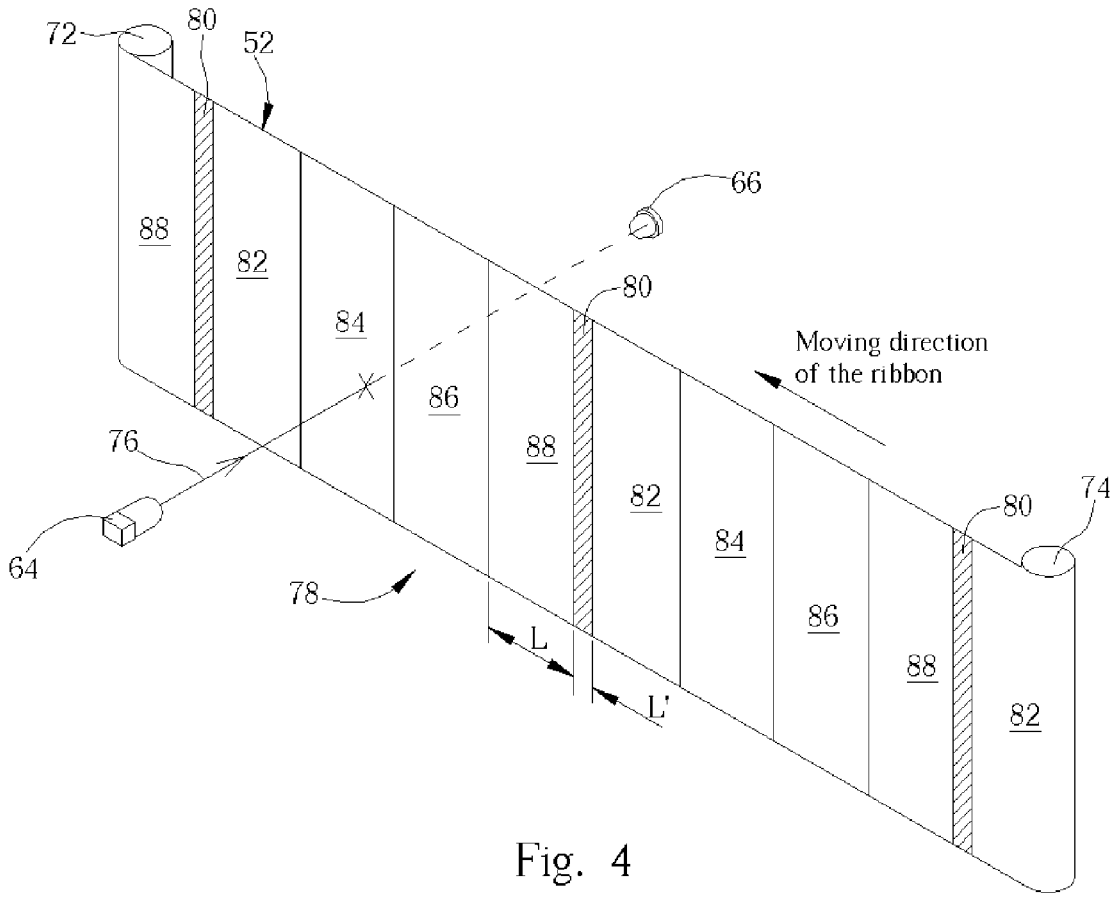
FIG. 4 is a diagram of a ribbon of the color printer according to the present invention.

Please refer to FIG. 4. FIG. 4 is a diagram of the ribbon 52 of the color printer 50 according to the present invention. The ribbon 52 includes a plurality of sequentially arranged dye regions 78. Each of the dye regions 78 includes four dye areas 82, 84, 86, 88 for carrying dye of different colors, and each of the dye areas 82, 84, 86, 88 has a substantially equal length L. The dye areas 82, 84, 86, 88 are used for separately placing yellow dye, magenta dye, cyan dye, and overcoating dye. Dividing sections 80 are positioned at the front end of each of the dye regions 78 respectively. Each of the dividing sections 80 has a substantially equal length L", which is shorter than the length L. The dividing sections 80 are opaque. When the first light source 64 emits a light beam 76 to the ribbon 52, the light sensor 66 can generate a sensing signal to the control module 60 by detecting the light beam 76 which is emitted from the first light source 64 and penetrates the ribbon 52. And when the light sensor 66 detects the dividing section 80, it can signal the control module 60 for the beginning position of the new dye region 78 of the ribbon 52, corresponding to the beginning position of the yellow dye area 82.

Figure 5:
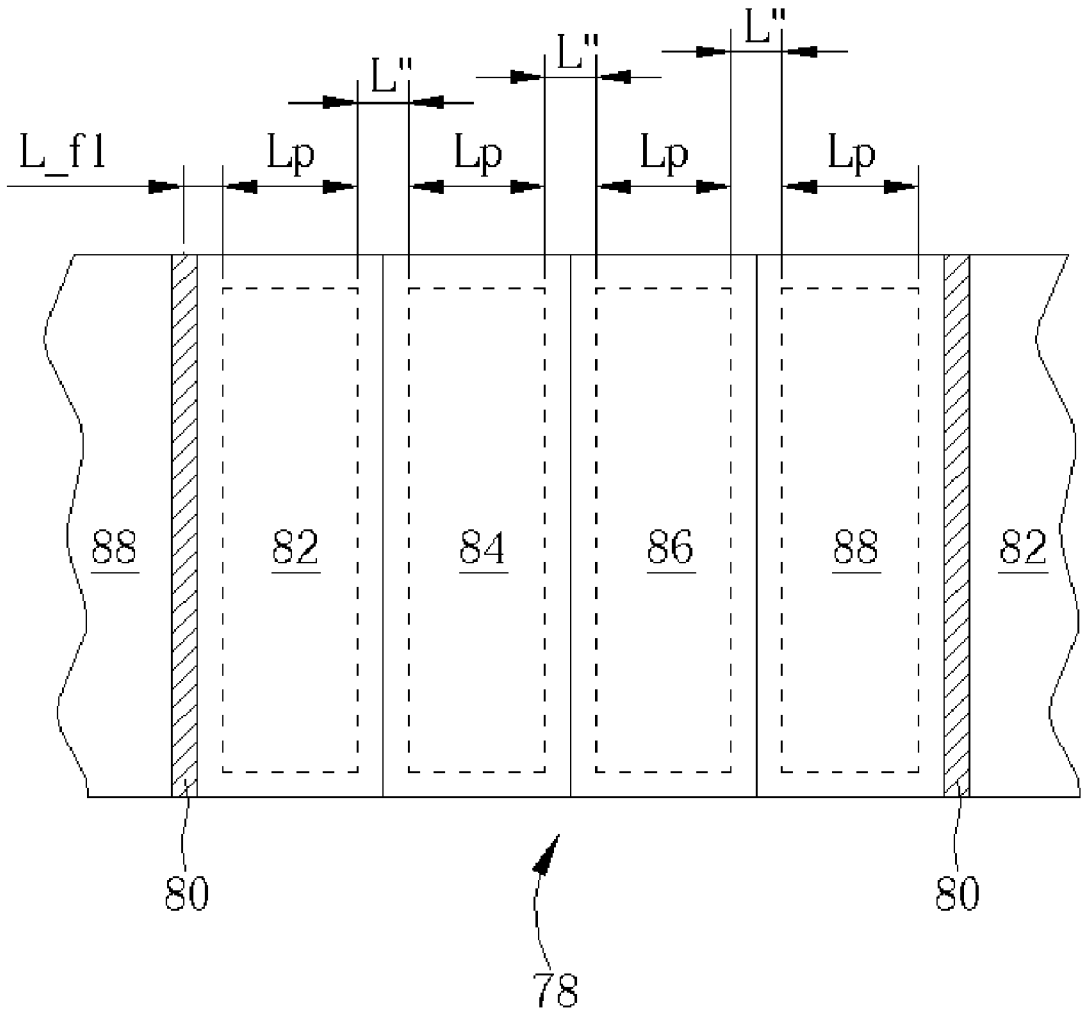
FIG. 5 is a diagram illustrating the print regions of the ribbon.

Please refer to FIG. 5. FIG. 5 is a diagram illustrating the print regions of the ribbon 52. The dye areas 82, 84, 86, 88 of each dye region 78 of the ribbon 52 are used for separately placing yellow dye, magenta dye, cyan dye, and overcoating dye for being printed onto a piece of photo paper. The printing range of the dye areas 82, 84, 86, 88 are on the inside of the dotted region. The length of the printing range is substantially equal to Lp, and the distance between the adjacent printing ranges is substantially equal to L" for ensuring that the next beginning print point of the print head 54 is located inside the next printing range. So the length L of the dye area will not be equal to the length Lp of the printing range. Furthermore, the distance between the dividing section 80 positioned in front of the yellow dye area 82 and the beginning print point of the yellow dye area 82 is substantially equal to L_f1.

Figure 6:
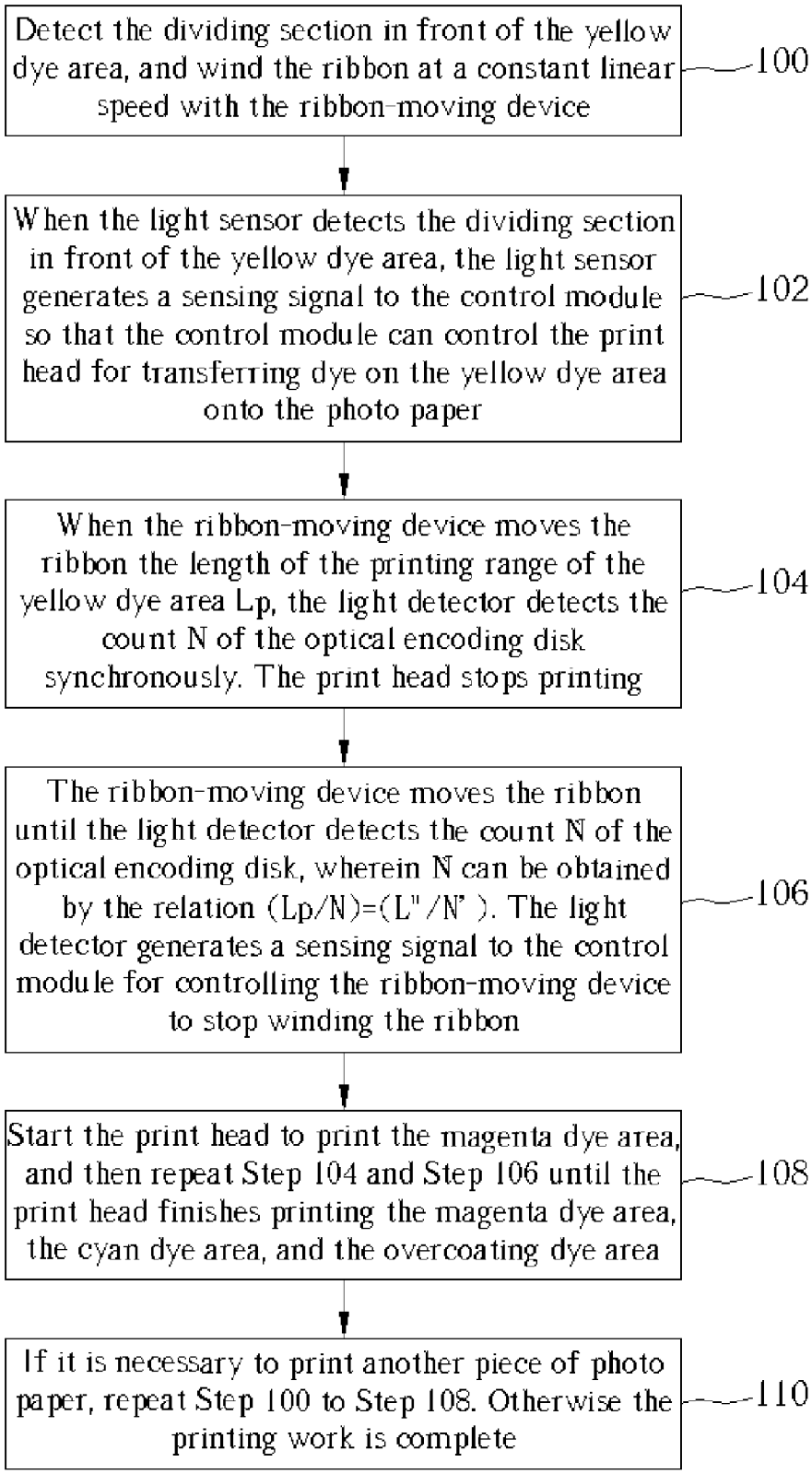
FIG. 6 is a flowchart illustrating actions that the color printer performs when printing an image on a piece of photo paper.
Figure 7:
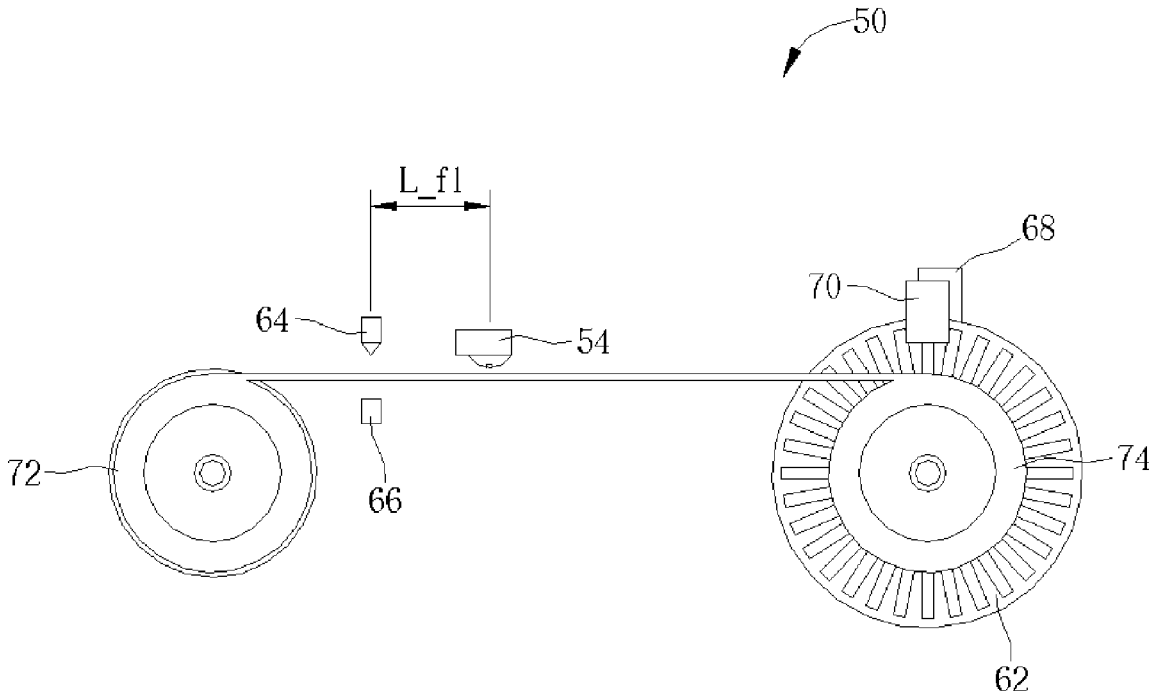
FIG. 7 is lateral view of the color printer according to the present invention.

Please refer to FIG. 6. FIG. 6 is a flowchart illustrating actions that the color printer 50 performs when printing an image on a piece of photo paper. The method includes:

Step 100: Start the first light source 64 and the light sensor 66 for detecting the dividing section 80 in front of the yellow dye area 82, and wind the ribbon 52 at a constant linear speed with the ribbon-moving device 56;

Step 102: Please refer to FIG. 7. FIG. 7 is a lateral view of the color printer 50 according to the present invention. The distance between the first light source 64 and the print head 54 and the distance between the light sensor 66 and the print head 54 are both substantially equal to length L_f1. So when the light sensor 66 detects the dividing section 80 in front of the yellow dye area 82, the print head 54 is positioned at the beginning print point of the yellow dye area 82. Simultaneously the light sensor 66 generates a sensing signal to the control module 60 so that the control module 60 can control the print head 54 for transferring dye on the yellow dye area 82 onto the piece of photo paper;

Step 104: Start the second light source 68 and the light detector 70. When the ribbon-moving device 56 moves the ribbon 52 the length of the printing range of the yellow dye area 82 Lp, the light detector 70 can detect the count N of the optical encoding disk 62 synchronously. Simultaneously the print head 54 finishes printing the yellow dye area 82 and the print head 54 stops printing;

Step 106: The ribbon-moving device 56 moves the ribbon 52 until the light detector 70 detects the count N of the optical encoding disk 62, wherein N" can be obtained by the relation (Lp/N)=(L"/N"). At the same time, the light detector 70 generates a sensing signal to the control module 60 for controlling the ribbon-moving device 56 to stop winding the ribbon 52. Thus, the print head 54 can locate on the beginning print point of the next magenta dye area 84;

Step 108: Start the print head 54 to print the magenta dye area 84, and then repeat Step 104 and Step 106 until the print head 54 finishes printing the magenta dye area 84, the cyan dye area 86, and the overcoating dye area 88. The color printer 50 finishes printing the piece of photo paper; and Step 110: If it is necessary to print to another photo paper, repeat Step 100 to Step 108. Otherwise the printing work is complete.

As mentioned above, the color print 50 can utilize the relation of the length Lp, the count N of the optical encoding disk 62, and the length L" to get the necessary count N" corresponding to the length L" that the ribbon-moving device 52 has to move the ribbon 52. That is, when the optical encoding disk 62 rotates by the count N", the ribbon 52 moves in the distance L". So the print head 54 can be accurately located at the beginning print point of the next dye area. The necessary count N" of the optical encoding disk 62 can be calculated after the print head 54 finishes printing one dye area and the count N is obtained. In addition, the count N corresponding to each dye area can be obtained by experiment before the color print 50 leaves the factory, so the necessary count N" corresponding to each dye area can be calculated and stored in the control module 60 of the color printer 50 in advance. Thus, the next count N" of the optical encoding disk 62 can be looked up from a stored table in the control module 60 after the print head 54 finishes printing one dye area and the count N is obtained. Furthermore, the control module 60 can recognize the present position of the dye region of the ribbon 52 according to the count of the optical encoding disk 62 for providing information about the used position of the ribbon 52. In addition, since one piece of photo paper is printed to by one dye region, a user can recognize how many dye regions have been printed onto pieces of photo paper and how many dye regions can be printed onto pieces of photo paper in the future.

Compared to the prior art color printer, the color printer of the present invention needs only a dividing section in front of the first dye area of a dye region to detect the beginning print point of the ribbon. The beginning print points of the other three dye areas are determined by counts of optical encoding disk instead of reserving additional dividing sections in front of three dye areas and the length L_f1. This increases the effective utilization of the ribbon. Besides, the present invention provides users with information about the used position of the ribbon and how many pieces of photo paper can be printed to in the future.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A color printer comprising:

a ribbon comprising a plurality of dye regions, each dye region comprising a plurality of dye areas for carrying dye of different colors;

a print head for transferring dye on the ribbon onto a subject;

a ribbon-moving device for moving the ribbon so that the print head can transfer the dye on each of the dye areas of one dye region onto the subject to form a color picture;

an optical sensing module installed on the side of the ribbon comprising an optical encoding disk driven by the ribbon-moving device for generating a count when the ribbon-moving device moves the ribbon; and a control module for controlling the ribbon-moving device to move the next dye region of the ribbon to the print head after finishing printing one dye region of the ribbon according to the count of the optical encoding disk.

2. The color printer of claim 1, wherein the ribbon further comprises at least one dividing section positioned between the two adjacent dye regions.

3. The color printer of claim 2, wherein the optical sensing module further comprises a first light source for emitting light to the ribbon and a light sensor, which generates a sensing signal to the control module by detecting light which is emitted from the first light source and penetrates the ribbon.

4. The color printer of claim 1, wherein the optical sensing module further comprises a second light source for emitting light to the optical encoding disk and a light detector for receiving light emitted from the second light source and passing through the optical encoding disk so as to obtain the count of the optical encoding disk.

5. The color printer of claim 1, wherein the ribbon-moving device rolls the ribbon at a substantially constant speed.

6. The color printer of claim 1, wherein each dye region comprises a yellow dye area, a magenta dye area, a cyan dye area, and an overcoating dye area.

7. The color printer of claim 1, wherein the control module can recognize the present position of the ribbon according to the count of the optical encoding disk.

8. The color printer of claim 1, wherein the color printer is a photo printer.

* * * * *